US011814282B2

(12) United States Patent
Long

(10) Patent No.: US 11,814,282 B2
(45) Date of Patent: Nov. 14, 2023

(54) FUEL DISPENSER WITH FRAUD RESISTANT FLOW CONTROL VALVE

(71) Applicant: Gilbarco Inc., Greensboro, NC (US)

(72) Inventor: Joseph Daniel Long, Oak Ridge, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 17/665,870

(22) Filed: Feb. 7, 2022

(65) Prior Publication Data

US 2022/0153569 A1 May 19, 2022

Related U.S. Application Data

(62) Division of application No. 15/432,246, filed on Feb. 14, 2017, now Pat. No. 11,242,239.

(51) Int. Cl.

| | |
|---|---|
| ***B67D 7/34*** | (2010.01) |
| ***B67D 7/04*** | (2010.01) |
| ***B67D 7/36*** | (2010.01) |

(52) U.S. Cl.

CPC ..... *B67D 7/344* (2013.01); *B67D 7/04* (2013.01); *B67D 7/36* (2013.01)

(58) Field of Classification Search

CPC ..... B67D 7/344; B67D 7/346; B67D 7/348
See application file for complete search history.

(56) References Cited

U.S. PATENT DOCUMENTS

| | | | |
|---|---|---|---|
| 4,397,405 | A | 8/1983 | Batson |
| 4,476,459 | A | 10/1984 | Cooper et al. |
| 5,447,062 | A | 9/1995 | Kopl et al. |
| 5,689,071 | A | 11/1997 | Ruffner et al. |
| 5,941,282 | A | 8/1999 | Suzuki et al. |
| 5,954,080 | A | 9/1999 | Leatherman |
| 5,996,965 | A | 12/1999 | Eichholz et al. |
| 6,067,476 | A | 5/2000 | Siler |
| 6,109,477 | A | 8/2000 | Myers et al. |
| 6,123,092 | A | 9/2000 | Torii |
| 6,164,323 | A | 12/2000 | Smith et al. |

(Continued)

FOREIGN PATENT DOCUMENTS

| | | | |
|---|---|---|---|
| EP | 1666406 | A2 | 6/2006 |
| WO | 2007148294 | A1 | 12/2007 |
| WO | 2008067507 | A2 | 6/2008 |

OTHER PUBLICATIONS

Wikipedia web page out of "File: Commercial Solenoid Dawes 1920.png" at http://en.wikipedia.org/wiki/File:Commercial_Solenoid_Dawes_1920.png, printed Feb. 20, 2013 all enclosed pages cited.

*Primary Examiner* — Timothy L Maust
(74) *Attorney, Agent, or Firm* — Nelson Mullins Riley & Scarborough LLP

(57) ABSTRACT

A flow control valve is provided including a valve aperture in a valve body configured to convey fuel from an inlet to an outlet, a valve element configured to close the valve aperture to block flow of the fuel, a valve actuator configured to shift the position of the valve element between a closed position and an open position, and an antifraud circuit. The antifraud circuit is configured to receive a signal to open the flow control valve, determine if the signal is legitimate based on a signal characteristic, cause the flow control valve to shift to the open position in response to determining that the signal is legitimate.

9 Claims, 7 Drawing Sheets

(56) References Cited

U.S. PATENT DOCUMENTS

| | | | | |
|---|---|---|---|---|
| 6,250,151 | B1 | 6/2001 | Tingleff et al. | |
| 6,296,148 | B1 | 10/2001 | Myers et al. | |
| 6,397,686 | B1 | 6/2002 | Taivalkoski et al. | |
| 6,435,204 | B2 | 8/2002 | White et al. | |
| 6,470,233 | B1 * | 10/2002 | Johnson, Jr. | G07F 7/1008 141/351 |
| 6,682,316 | B1 | 1/2004 | Boke | |
| 7,111,520 | B2 | 9/2006 | Payne et al. | |
| 7,252,112 | B1 | 8/2007 | Imler et al. | |
| 7,701,314 | B2 | 4/2010 | Hazzard et al. | |
| 7,912,577 | B2 | 3/2011 | Siler | |
| 7,946,309 | B2 | 5/2011 | Reid et al. | |
| 8,096,446 | B2 | 1/2012 | Carapelli | |
| 8,285,506 | B2 | 10/2012 | Oldham et al. | |
| 8,291,928 | B2 | 10/2012 | Reid et al. | |
| 9,523,597 | B2 * | 12/2016 | Williams | G01F 15/007 |
| 9,817,042 | B2 * | 11/2017 | Benton | G01R 19/165 |
| 9,823,665 | B2 * | 11/2017 | Finnell | B67D 7/344 |
| 11,008,210 | B2 * | 5/2021 | Carapelli | B67D 7/34 |
| 11,242,239 | B2 | 2/2022 | Long | |
| 2001/0048244 | A1 | 12/2001 | Altenrenger et al. | |
| 2005/0262027 | A1 | 11/2005 | Hutchinson et al. | |
| 2005/0273205 | A1 | 12/2005 | Nickerson et al. | |
| 2006/0242971 | A1 | 11/2006 | Cole et al. | |
| 2007/0267088 | A1 | 11/2007 | Hughes | |
| 2008/0203339 | A1 | 8/2008 | Kato et al. | |
| 2009/0265638 | A1 | 10/2009 | Carapelli et al. | |
| 2010/0262385 | A1 | 10/2010 | Chen et al. | |
| 2011/0031267 | A1 | 2/2011 | Liebal et al. | |
| 2011/0185319 | A1 | 7/2011 | Carapelli | |
| 2011/0213683 | A1 | 9/2011 | Betancourt | |
| 2011/0238511 | A1 | 9/2011 | Park et al. | |
| 2012/0286760 | A1 | 11/2012 | Carapelli et al. | |
| 2014/0019359 | A1 | 1/2014 | Abrams et al. | |
| 2014/0300372 | A1 | 10/2014 | Benton et al. | |
| 2015/0267800 | A1 | 9/2015 | Phillips et al. | |
| 2016/0034899 | A1 | 2/2016 | Myers et al. | |
| 2016/0125412 | A1 | 5/2016 | Cannon | |
| 2016/0148194 | A1 | 5/2016 | Guillaud et al. | |
| 2016/0260069 | A1 | 9/2016 | Holman et al. | |

* cited by examiner

FUEL DISPENSER WITH FRAUD RESISTANT FLOW CONTROL VALVE

CROSS-REFERENCE TO RELATED APPLICATION

This is a divisional application of co-pending application Ser. No. 15/432,246, filed Feb. 14, 2017. The aforementioned application is incorporated herein by reference in its entirety for all purposes.

BACKGROUND

The present invention relates generally to equipment used in fuel dispensing environments. More specifically, embodiments of the present invention relate to a fuel dispenser with a fraud resistant flow control valve.

Some fuel dispensers may be configured for use with pressurized fuel tanks or a common fuel line which is pressurized when in use. Authorized dispensing of fuel may be controlled by a flow control valve within the dispenser. A controller may receive payment information or authorization and cause the flow control valve to open, which may allow the fuel to be dispensed by operation of a fuel nozzle. However, in some configurations an external power supply or other unauthorized power source may be used without authorization to cause the flow control valve to open in the absence of the legitimate control signal, resulting in the theft of fuel.

SUMMARY

The present invention recognizes and addresses various considerations of prior art constructions and methods. According to one aspect, the present invention provides a flow control valve including a valve aperture in a valve body configured to convey fuel from an inlet to an outlet, a valve element configured to close the valve aperture to block flow of the fuel, a valve actuator configured to shift the position of the valve element between a closed position and an open position, and an antifraud circuit. The antifraud circuit is configured to receive an actuation signal to open the flow control valve, determine if the signal is legitimate based on a signal characteristic, cause the flow control valve to shift to the open position in response to determining that the signal is legitimate.

In another example embodiment, a fuel dispenser is provided including a fuel nozzle configured to be connected to a vehicle fuel system, fuel piping configured to transfer fuel from at least one fuel storage tank associated with the fuel dispenser through the fuel nozzle into the vehicle fuel system, and a flow control valve. The flow control valve includes a valve aperture in a valve body configured to convey the fuel from an inlet to an outlet, a valve element configured to close the valve aperture to block flow of the fuel, a valve actuator configured to shift the position of the valve element between a closed position and an open position, and an antifraud circuit. The antifraud circuit is configured to receive an actuation signal to open the flow control valve, determine if the signal is legitimate based on a signal characteristic, cause the flow control valve to shift to the open position in response to determining that the signal is legitimate.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one skilled in the art, is set forth in the specification, which makes reference to the appended drawings, in which.

DETAILED DESCRIPTION OF PREFERRED EMBODIMENTS

Figure 1:
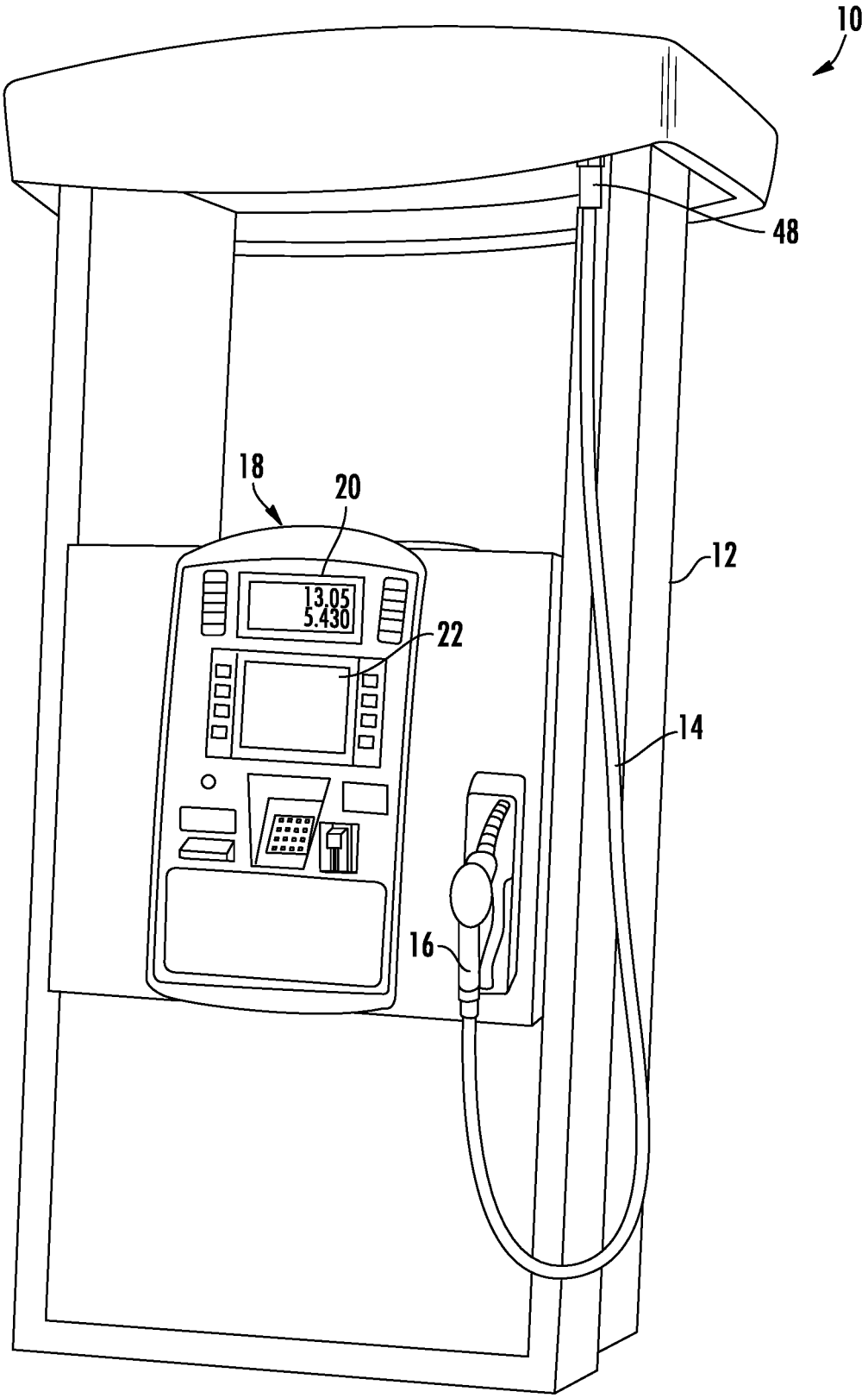
FIG. 1 illustrates a perspective view of an exemplary fuel dispenser in accordance with an embodiment of the present invention.

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the present disclosure including the appended claims and their equivalents.

A flow control valve for a fuel dispenser may be provided that includes an antifraud circuit. The antifraud circuit may be configured to determine if a signal to open the control valve is legitimate and cause the flow control valve to open or determine that the signal is not legitimate and cause the flow control valve to close (including causing the flow control valve to remain closed). In the absence of the antifraud circuit, the illegitimate signal might be sufficient to cause the valve to open but this is prevented by the antifraud circuit. Implementation of the antifraud circuit may thus prevent or limit theft of fuel by attempts to power the flow control valve from another source.

The antifraud circuit may determine if the signal is legitimate based on one or more signal characteristics, such as a predetermined signal pattern or modulation, an authentication message, cryptography, or the like. In an example embodiment, the antifraud circuit may be configured to pass a pulse width modulated (PWM) actuation signal to the flow control valve and shunt a direct current signal to ground. In some example embodiments, the pulse width modulation of the open signal may cause valve element of the flow control valve to oscillate, eliminating or reducing instances of the flow control valve becoming stuck.

In some example embodiments, the antifraud circuit may be disposed within a housing of the flow control valve, such as within a magnetic coil housing. For example, the antifraud circuit may be embedded (e.g., "potted") in the magnetic coil housing. The placement of the antifraud circuit within the housing may prevent bypassing of the antifraud circuit. In some embodiments, the antifraud circuit may be configured as or include an integrated circuit.

Some embodiments of the present invention may be particularly suitable for use with a fuel dispenser in a retail service station environment, and the below discussion will describe some preferred embodiments in that context. However, those of skill in the art will understand that the present invention is not so limited. In fact, it is contemplated that embodiments of the present invention may be used with any suitable fluid dispenser. For example, embodiments of the present invention may also be used with diesel exhaust fluid (DEF) dispensers, compressed natural gas (CNG) dispensers, and liquefied petroleum gas (LPG) and liquid natural gas (LNG) applications, among others.

Example Fuel Dispenser

FIG. 1 is a perspective view of an exemplary fuel dispenser 10 according to an embodiment of the present invention. Fuel dispenser 10 includes a housing 12 with a flexible fuel hose 14 extending therefrom. Fuel hose 14 terminates in a fuel nozzle 16 adapted to be inserted into a fill neck of a vehicle's fuel tank. Fuel nozzle 16 includes a manually-operated fuel valve. Various fuel handling components, such as valves and meters, are also located inside of housing 12. These fuel handling components allow fuel to be received from underground piping and delivered through fuel hose 14 and fuel nozzle 16 to a vehicle's fuel system, e.g. fuel tank.

Fuel dispenser 10 has a customer interface 18. Customer interface 18 may include an information display 20 relating to an ongoing fueling transaction that includes the amount of fuel dispensed and the price of the dispensed fuel. Further, customer interface 18 may include a display 22 that provides instructions to the customer regarding the fueling transaction. Display 22 may also provide advertising, merchandising, and multimedia presentations to a customer, and may allow the customer to purchase goods and services other than fuel at the dispenser.

Figure 2:
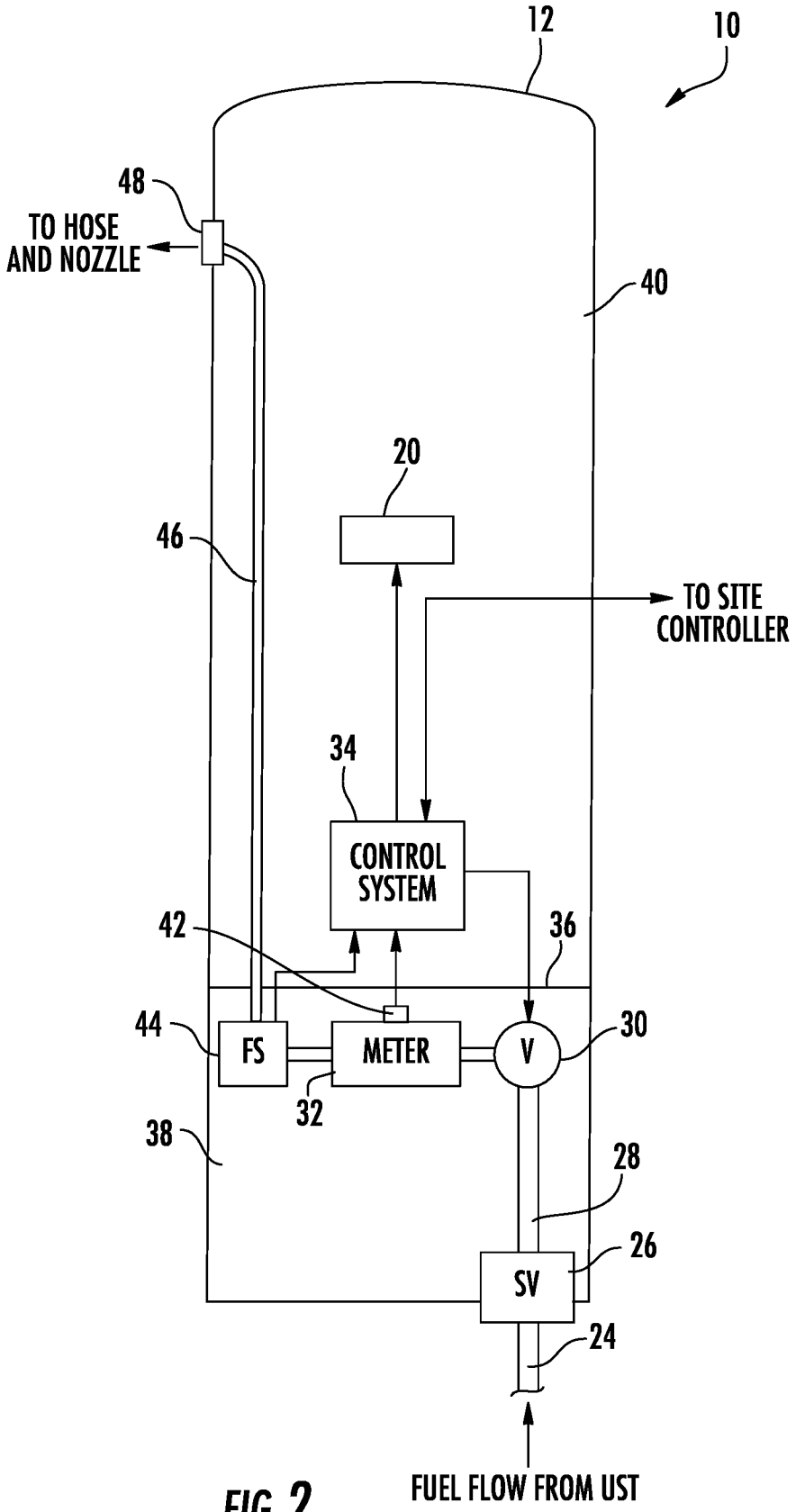
FIG. 2 illustrates a diagrammatic representation of internal components of the fuel dispenser of FIG. 1 according to an embodiment of the present invention.

FIG. 2 is a schematic illustration of internal fuel flow components of fuel dispenser 10 according to an embodiment of the present invention. In general, fuel of a particular grade or type may travel from an underground storage tank (UST) via main fuel piping 24, which may be a double-walled pipe having secondary containment as is well known, to fuel dispenser 10 and nozzle 16 for delivery. An exemplary underground fuel delivery system is illustrated in U.S. Pat. No. 6,435,204, hereby incorporated by reference in its entirety for all purposes. More specifically, a submersible turbine pump (STP) associated with the UST is used to pump fuel to the fuel dispenser 10. However, some fuel dispensers may be self-contained, meaning fuel is drawn to the fuel dispenser 10 by a pump unit positioned within housing 12.

Main fuel piping 24 passes into housing 12 through a shear valve 26. As is well known, shear valve 26 is designed to close the fuel flow path in the event of an impact to fuel dispenser 10. U.S. Pat. No. 8,291,928, hereby incorporated by reference in its entirety for all purposes, discloses an exemplary secondarily-contained shear valve adapted for use in service station environments. Shear valve 26 contains an internal fuel flow path to carry fuel from main fuel piping 24 to internal fuel piping 28.

Fuel from the shear valve 26 flows toward a flow control valve 30 positioned upstream of a flow meter 32. Alternatively, flow control valve 30 may be positioned downstream of the flow meter 32. In one embodiment, flow control valve 30 may be a proportional solenoid controlled valve. Flow control valve 30 preferably includes an antifraud circuit as described below in reference to FIGS. 3-6.

Flow control valve 30 is under control of a control system 34. In this manner, control system 34 can control the opening and closing of flow control valve 30 to either allow fuel to flow or not flow through meter 32 and on to the hose 14 and nozzle 16. Control system 34 may comprise any suitable electronics with associated memory and software programs running thereon whether referred to as a processor, microprocessor, controller, microcontroller, or the like. In a preferred embodiment, control system 34 may be comparable to the microprocessor-based control systems used in CRIND (card reader in dispenser) type units sold by Gilbarco Inc. Control system 34 typically controls other aspects of fuel dispenser 10, such as other valves, displays, and the like. For example, control system 34 typically instructs flow control valve 30 to open when a fueling transaction is authorized. In addition, control system 34 may be in electronic communication with a point-of sale system (site controller) located at the fueling site. The site controller communicates with control system 34 to control authorization of fueling transactions and other conventional activities.

A vapor barrier 36 delimits hydraulics compartment 38 of fuel dispenser 10, and control system 34 is located in electronics compartment 40 above vapor barrier 36. Fluid handling components, such as flow meter 32, are located in hydraulics compartment 38. In this regard, flow meter 32 may be any suitable flow meter known to those of skill in the art, including positive displacement, inferential, and Coriolis mass flow meters, among others. Meter 32 typically comprises electronics 42 that communicates information representative of the flow rate or volume to control system 34. For example, electronics 42 may typically include a pulser as known to those skilled in the art. In this manner, control system 34 can update the total gallons (or liters) dispensed and the price of the fuel dispensed on information display 20.

As fuel leaves flow meter 32 it enters a flow switch 44, which preferably comprises a one-way check valve that prevents rearward flow through fuel dispenser 10. Flow switch 44 provides a flow switch communication signal to control system 34 when fuel is flowing through flow meter 32. The flow switch communication signal indicates to control system 34 that fuel is actually flowing in the fuel delivery path and that subsequent signals from flow meter 32 are due to actual fuel flow. Fuel from flow switch 44 exits through internal fuel piping 46 to fuel hose 14 and nozzle 16 for delivery to the customer's vehicle.

In an example embodiment, a breakaway device 48 may connect the internal piping 46 to the hose 14. The breakaway device 48 may be configured to detach from the dispenser 10 and/or internal piping 46 in response to a force applied to the breakaway device 48 exceeding a predetermined threshold, for example 100 lbs or more. An example of a suitable breakaway device 48 is disclosed in U.S. Pat. No. 7,252,112, incorporated by reference herein in its entirety for all purposes.

A blend manifold may also be provided downstream of flow switch 44. The blend manifold receives fuels of varying octane levels from the various USTs and ensures that fuel of the octane level selected by the customer is delivered. In addition, fuel dispenser 10 may comprise a vapor recovery system to recover fuel vapors through nozzle 16 and hose 14 to return to the UST. An example of a vapor recovery assist equipped fuel dispenser is disclosed in U.S. Pat. No. 5,040,577, incorporated by reference herein in its entirety for all purposes.

Example Fuel Flow Control Valve

Figure 3:
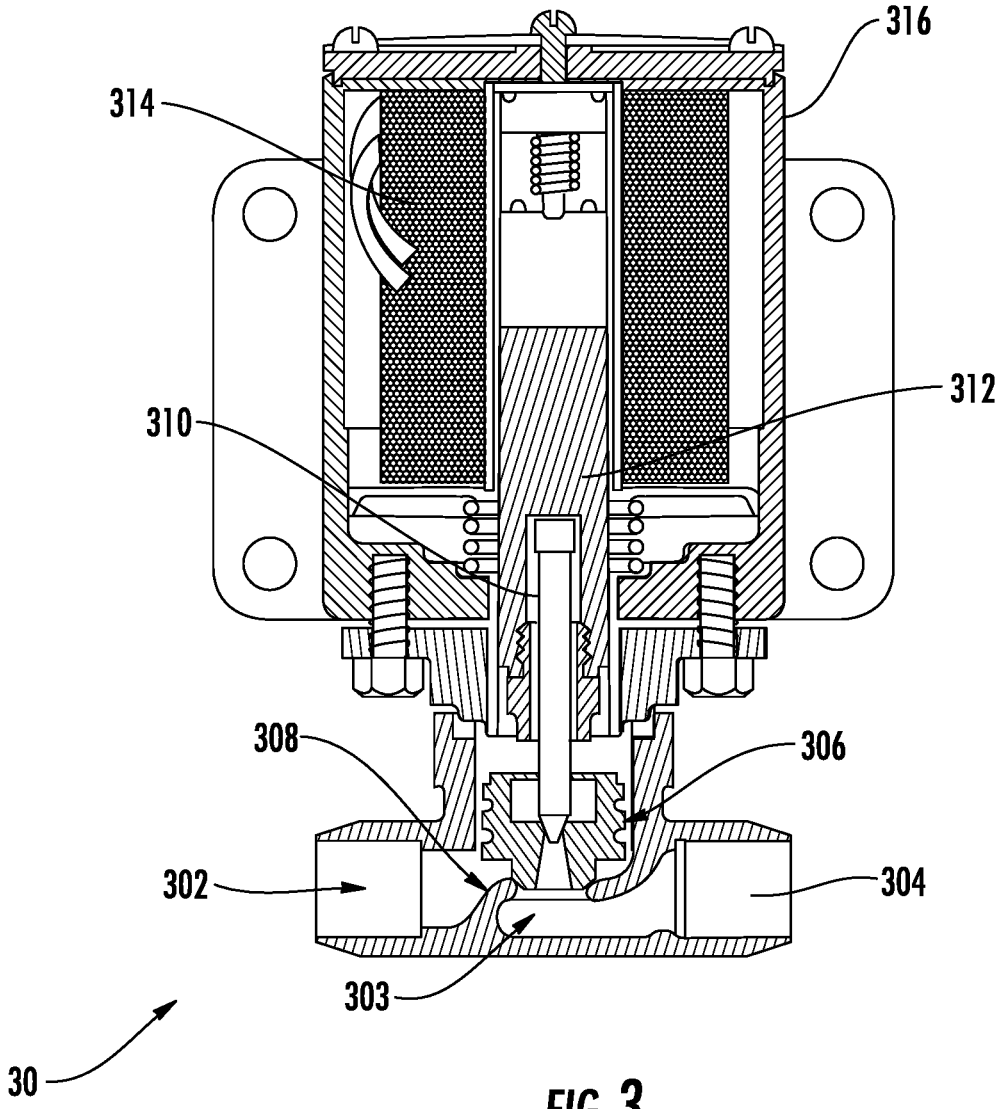
FIG. 3 illustrates an example flow control valve according to an embodiment of the present invention.

FIG. 3 illustrates an example flow control valve 30 according to an example embodiment. The flow control valve 30 may include an inlet 302 which receives fuel from the UST. The fuel may pass from the inlet 302 to the outlet 304, which may be operably coupled to the meter 34 or other internal piping 46, through an aperture 303 in the valve body 308. The flow control valve 30 may include a valve element (here in the form of a valve disc 306) configured to control the flow of fuel from the inlet 302 to the outlet 304. The valve disc 306 and/or the valve body 308 may be configured such that the flow control valve 30 is a proportional valve, e.g. the amount of flow of fuel from the inlet 302 to the outlet 304 is proportional to the distance of the valve disc 306 from the aperture 303.

In an example embodiment, the valve disc 306 may be operably coupled to a valve stem 310. The valve stem 310 may be operably coupled to a valve actuator. The valve actuator may be a servo motor, solenoid, or the like. In the depicted example, the valve actuator is a solenoid including a magnetic slug, e.g. a plunger 312, surrounded by a magnetic coil 314. The magnetic coil 314, plunger 312, and at least a portion of the valve stem 310 may be disposed in a housing 316. The magnetic coil 314 may include its own housing or insulation covering, which may be disposed within the valve housing 316. In some embodiments, the flow control valve 30 may include an antifraud circuit 500, as discussed below in reference to FIG. 4. The antifraud circuit 500 may be disposed within the valve housing 316 and/or the magnetic coil housing to limit or eliminate bypassing of the antifraud circuit 500. In embodiments where it is possible to remove the magnetic coil 314, it is often preferable if the coil stem's diameter is larger than usual or is otherwise unique so that another coil could not be substituted.

The magnetic coil 314 may induce a magnetic field when energized. The magnetic field may shift the plunger 312, thereby shifting the valve disc 306, via the valve stem 310, from its normally closed position to an open position. (Alternatively, it may be desirable in some embodiments for the magnetic field to cause the plunger 312 to shift in an opposite direction such that the valve disc 306 shifts from the open position to the closed position.) In an example embodiment, in which the flow control valve is a proportional valve, as discussed below, any position in which the flow control valve is not in the closed position is understood to be an "open position."

Figure 4:
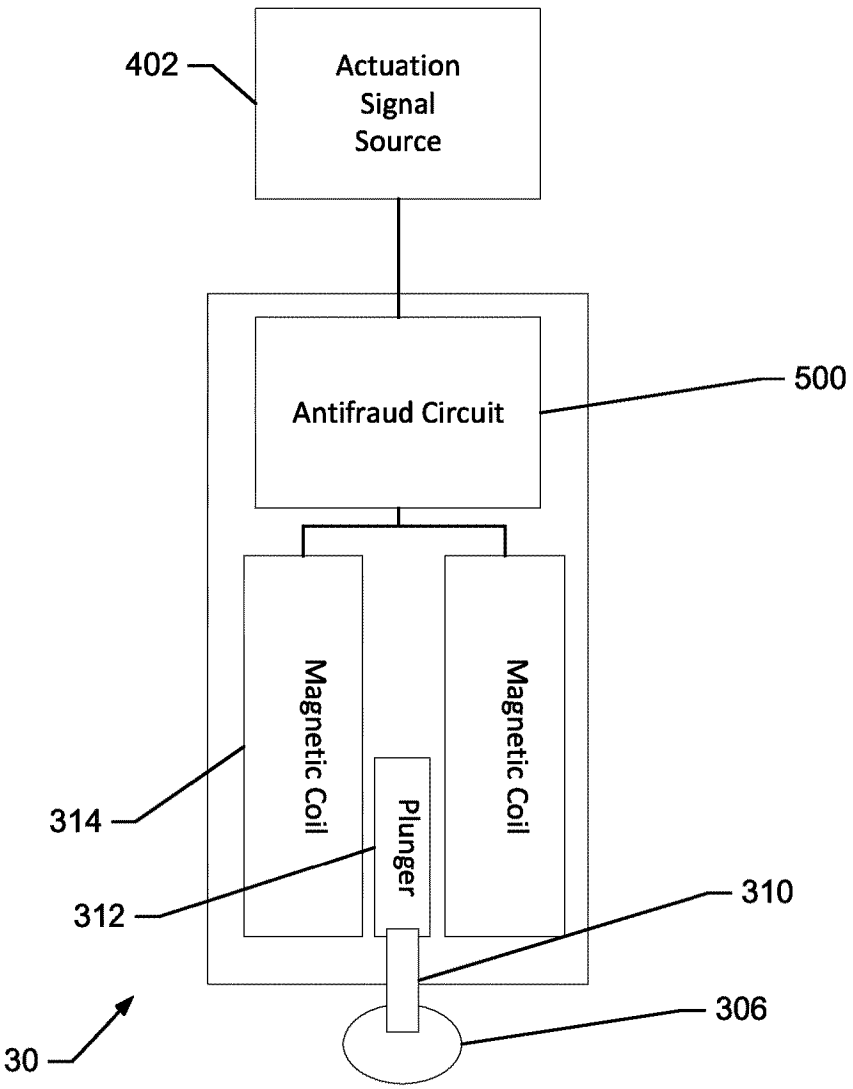
FIG. 4 is a diagrammatic representation of the flow control valve of FIG. 3 according to an example embodiment.

FIG. 4 is a diagrammatic representation of flow control valve 30 including an antifraud circuit 500 embedded in its housing. In an example embodiment, the antifraud circuit 500 may receive a signal from an actuation signal source 402 (such as control system 34 or an unauthorized source) to open the flow control valve 30. The antifraud circuit 500 may determine if the signal is legitimate based on one or more signal characteristics. In response to a legitimate signal, the antifraud circuit 500 may cause the flow control valve 30 to open (such as by simply passing the signal). In response to a signal which is determined to not be legitimate, the antifraud circuit 500 may cause the flow control valve 30 to close (or remain closed), such as by blocking or bypassing the signal.

Figure 4A:
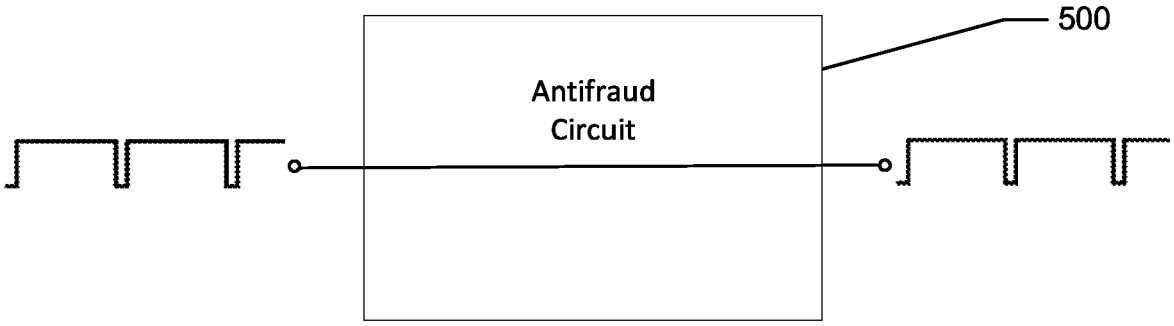
FIGS. 4A and 4B diagrammatically illustrate operation of an exemplary antifraud circuit in the flow control valve of FIG. 4 when the actuation signal is legitimate and not legitimate, respectively.
Figure 4B:
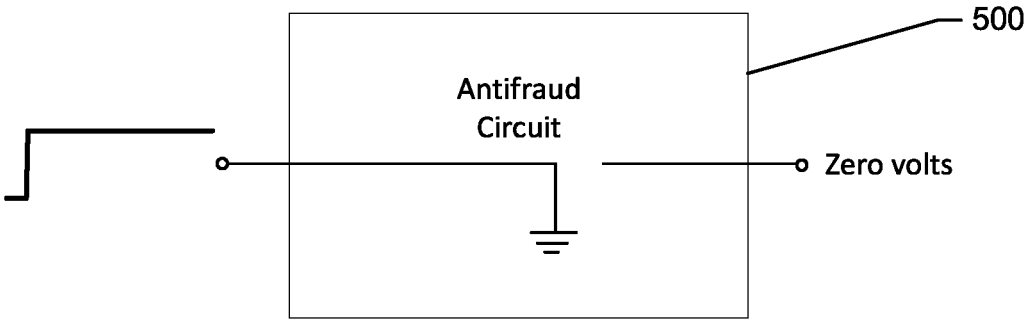

Referring now to FIGS. 4A and 4B, the controller 34 may send a signal to open the flow control valve 30. The signal may include a predetermined signal pattern or modulation, such as pulse width modulation. As shown in FIG. 4A, the antifraud circuit 500 is configured in this embodiment to pass the pulse width modulated signal to the flow control valve 30, e.g. the magnetic coil 314 of the flow control valve 30, causing the flow control valve 30 to open. As shown in FIG. 4B, the antifraud circuit 500 is configured in this embodiment to shunt the power signal to ground in response to a direct current power signal, such as 12 VDC (that may come, for example from a battery rather than the intended drive circuitry for the valve). As a result, flow control valve 30 will be prevented from opening in response to the illegitimate signal. Similarly, the antifraud circuit 500 may be configured to block or shunt to ground signals that do not match a predetermined signal pattern.

In some embodiments, the antifraud circuit 500 may include processing circuitry 70, such as discussed below in reference to FIG. 5. The processing circuitry 70 may allow source 402 to supply power to the flow control valve 30 to open the flow control valve 30. The source 402 may be a direct current power supply, such as 12 VDC, a pulse width modulated power supply or the like. If the signal is deemed to be legitimate, the processing circuitry may allow the source 402 to supply power to the flow control valve 30 by biasing transistor(s) or other electronic switching elements.

In an example embodiment, the actuation signal may be indicative of an amount or proportion to open the flow control valve 30. The duty cycle of the pulse width modulation of the signal may be utilized to achieve proportional control, for example the "on" time of the cycle may indicate the degree to which the flow control valve is opened. In another example embodiment, the controller 34 and/or the processing circuitry 70 may regulate the power supplied to the flow control valve 30 to control the amount that the flow control valve opens based on information in the incoming signal.

In some example embodiments, the processing circuitry 70 may compare the signal pattern to a predetermined signal pattern, such as a modulation pattern. Moreover, the processing circuitry 70 may utilize cryptography or cryptographic data to verify an authentication message accompanying an open command signal sent from actuation signal source 402. The processing circuitry 70 may cause the flow control valve 30 to open in response to an open command (signal) with a valid or legitimate authentication message. The cryptography may be established between the controller 34 and the antifraud circuit 500 and include a message authentication code, keyed hashing function, or the like.

In an example embodiment, the antifraud circuit 500 may be further configured to cause an alert in response to receiving a signal determined not to be legitimate. The alert may be an audio indication such as a buzzer, siren, alarm, or the like. Additionally or alternatively, the alert may be a visual indication, such as a flashing light, strobe light, or the like. The alert may be at the dispenser, inside of a convenience store associated with the fueling environment, or at a remote location. The alert may indicate to fueling environment employees and/or customers that an unauthorized fueling event is occurring.

In an example embodiment, the antifraud circuit 500 may enable the flow control valve 30 to be controlled remotely, such as by a remote computing device, via the controller 34. The remote computing device may cause the flow control valve 30 to close or open, such as in response to an alert.

Example Processing Circuitry

Figure 5:
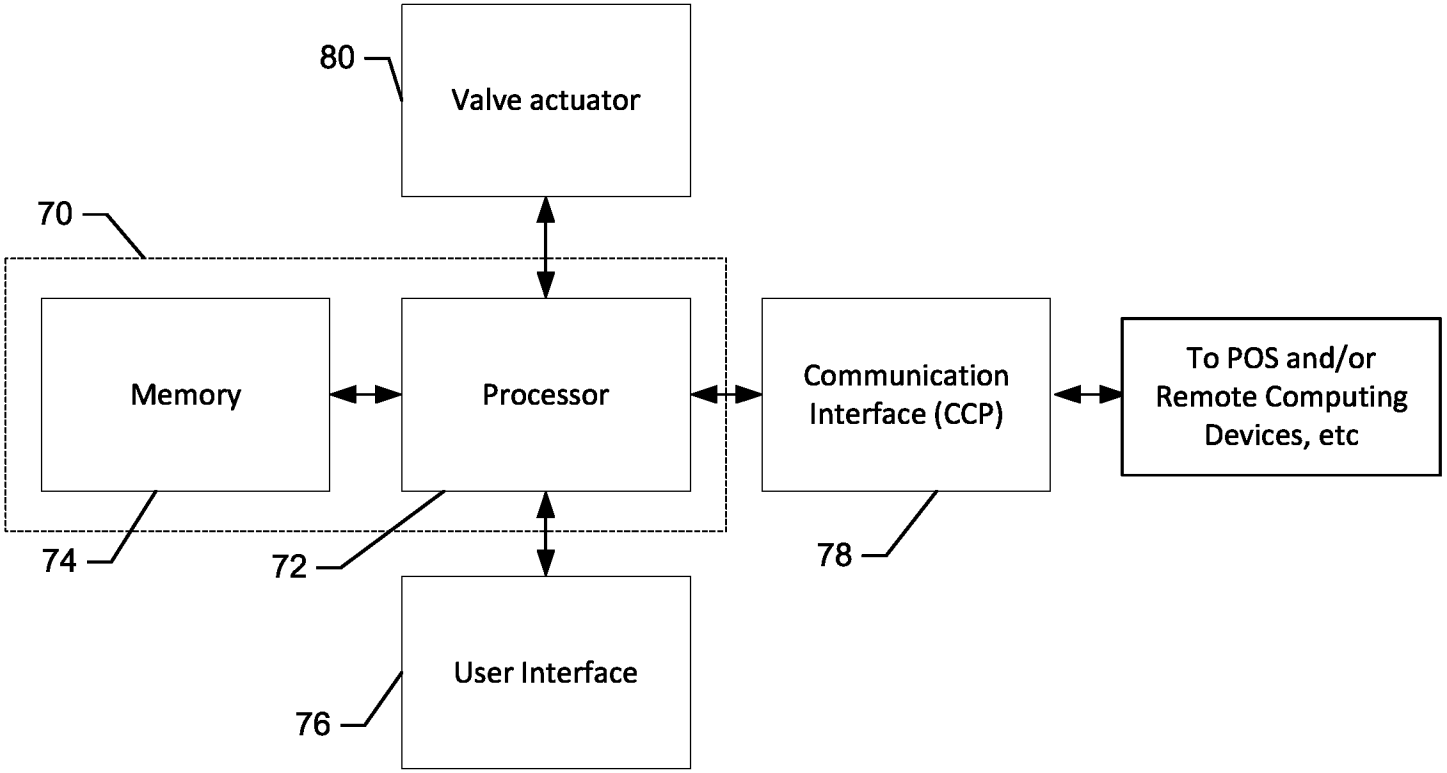
FIG. 5 illustrates a block diagram of one example of processing circuitry according to an embodiment of the present invention.

FIG. 5 shows certain elements of processing circuitry 70 according to an example embodiment. The processing circuitry 70 of FIG. 5 may be employed, for example, on onboard circuitry within the flow control valve 30, e.g. within the antifraud circuit 500, in circuitry associated with the control system 34, a convenience store, a network device, server, proxy, or the like. Alternatively, embodiments may be employed on a combination of devices. Furthermore, it should be noted that the devices or elements described below may not be mandatory and thus some may be omitted in certain embodiments.

In an example embodiment, processing circuitry 70 is provided to perform data processing, application execution and other processing and management services. In one embodiment, the processing circuitry 70 may include a memory 74 and a processor 72 that may be in communication with or otherwise control a user interface 76 and/or communication interface 78. As such, the processing circuitry 70 may be embodied as a circuit chip (e.g. an integrated circuit chip) configured (e.g., with hardware, software or a combination of hardware and software) to perform operations described herein. However, in some embodiments, the processing circuitry 70 may be embodied as a portion of a server, computer, or workstation. The network may be a data network, such as a local area network (LAN), a metropolitan area network (MAN), a wide area network (WAN) (e.g. the Internet), and/or the like, which may couple the processing circuity 70, the control system 34, and/or the fuel dispenser 10 to devices such as processing elements (e.g. computer terminals, server computers or the like) and/or databases. Communication between the network, the processing circuity 70, the control system 34, and the devices or databases (e.g., servers) to which the processing circuity 70 is coupled may be accomplished by either wireline or wireless communication mechanisms and corresponding communication protocols.

The user interface 76 may be an input/output device for receiving instructions from a user. The user interface 76 may be in communication with the processing circuitry 70 to receive user input via the user interface 76 and/or to present output to a user as, for example, audible, visual, mechanical or other output indications. The user interface 76 may include, for example, a keyboard, a mouse, a joystick, a display (e.g., a touch screen display), a microphone, a speaker, or other input/output mechanisms. Further, the processing circuitry 70 may comprise, or be in communication with, user interface circuitry configured to control at least some functions of one or more elements of the user interface 76. The processing circuitry 70 and/or user interface circuitry may be configured to control one or more functions of one or more elements of the user interface 76 through computer program instructions (e.g., software and/or firmware) stored on a memory device accessible to the processing circuitry 70 (e.g., volatile memory, non-volatile memory, and/or the like). In some example embodiments, the user interface circuitry is configured to facilitate user control of at least some functions of the apparatus through the use of a display configured to respond to user inputs. The processing circuitry 70 may also comprise, or be in communication with, display circuitry configured to display at least a portion of a user interface 76, the display and the display circuitry configured to facilitate user control of at least some functions of the apparatus.

The communication interface 78 may be any means such as a device or circuitry embodied in either hardware, software, or a combination of hardware and software that is configured to receive and/or transmit data from/to a network and/or any other device or module in communication with the control system 34 and/or the POS of the fueling environment (and/or a remote cloud server, either directly or via a router located in the convenience store). In some instances, the communications interface 78 may be referred to as a cloud connection processor (CCP) and may provide secured, e.g. encrypted, communication between the processing circuity 70, the network, and/or remote servers or remote computing devices. The communication interface 78 may also include, for example, an antenna (or multiple antennas) and supporting hardware and/or software for enabling communications with the network or other devices (e.g. a user device). In some environments, the communication interface 78 may alternatively or additionally support wired communication. As such, for example, the communication interface 78 may include a communication modem and/or other hardware/software for supporting communication via cable, digital subscriber line (DSL), universal serial bus (USB) or other mechanisms. In an exemplary embodiment, the communication interface 78 may support communication via one or more different communication protocols or methods. In some cases, IEEE 802.15.4 based communication techniques such as WiFi, ZigBee, Bluetooth, or other low power, short range communication protocols, such as a proprietary technique based on IEEE 802.15.4 may be employed along with radio frequency identification (RFID) or other short range communication techniques.

In some implementations, the processing circuitry 70 may also include or otherwise be in communication with a valve actuator 80 of the flow control valve 30. The valve actuator may include the magnetic coil 314 and plunger 312, a servo motor, a power transistor, or other device to control the position of the flow control valve 30. According to such embodiments, the processing circuitry 70 may receive a signal to open the flow control valve, determine if the signal is legitimate based on a signal characteristic, and cause the flow control valve to shift to the open position in response to determining that the signal is legitimate.

Example Flowchart(s) and Operations

Embodiments of the present invention provide methods, apparatus and/or computer program products for preventing unauthorized dispensing of fuel using a fuel flow control valve. Various examples of the operations performed in accordance with embodiments of the present invention will now be provided with reference to FIG. 6.

Figure 6:
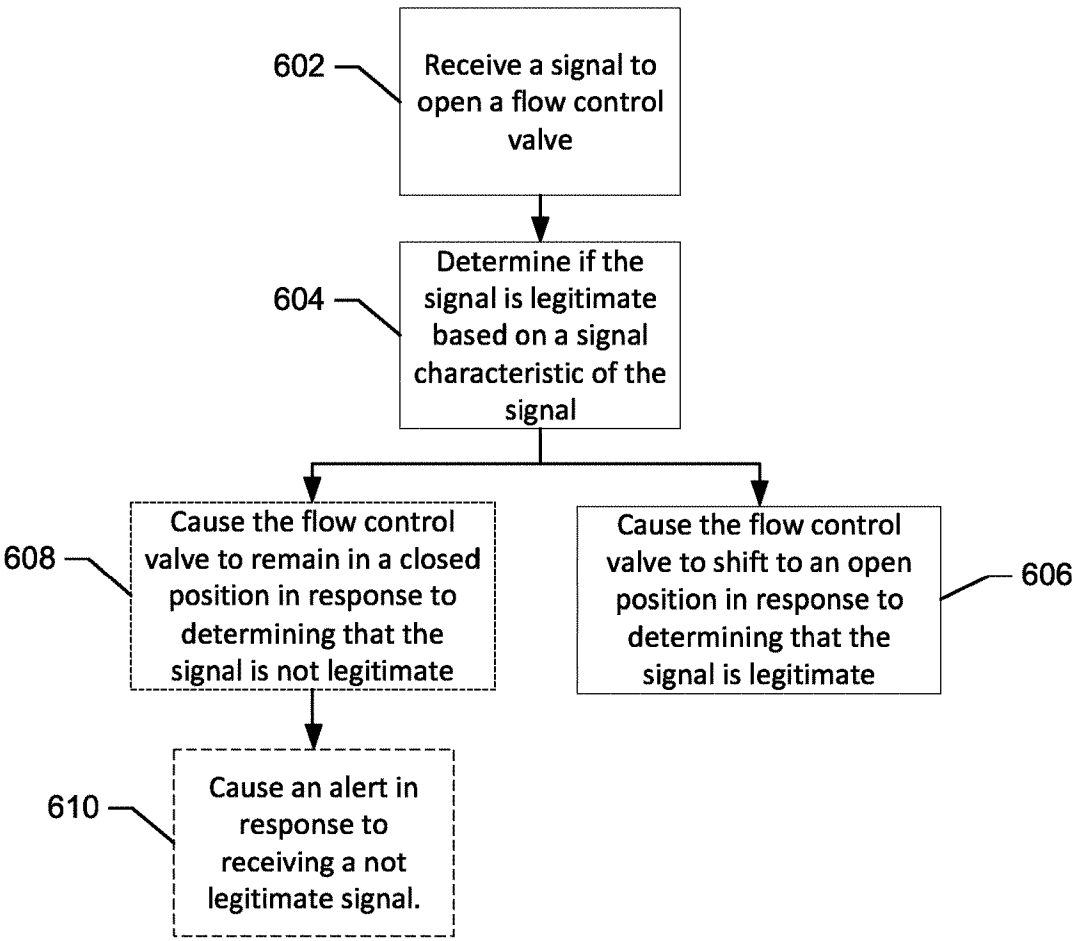
FIG. 6 illustrates a method of utilizing a flow control valve according to an example embodiment of the present invention.

The operations illustrated in and described with respect to FIG. 6 may, for example, be performed by, with the assistance of, and/or under the control of one or more of the processor 72, memory 74, communication interface 78, antifraud circuit 500, and/or the valve actuator 80. The method depicted in FIG. 6 may include receiving a signal to open a flow control valve at operation 602, determining if the signal is legitimate based on a signal characteristic of the signal at operation 604, and causing (e.g., allowing) the flow control valve to shift to an open position in response to determining that the signal is legitimate at operation 606.

In some embodiments, the method may include additional, optional operations, and/or the operations described above may be modified or augmented. Some examples of modifications, optional operations, and augmentations are described below, as indicated by dashed lines, such as, causing the flow control valve to remain in a closed position in response to determining that the signal is not legitimate at operation 608 and causing an alert in response to receiving a not legitimate signal at operation 610.

FIG. 6 illustrates a flowchart of a system, method, and/or computer program product according to an example embodiment. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 74 and executed by, for example, the processor 72. As will be appreciated, any such computer program product may be loaded onto a computer or other programmable apparatus (for example, the processing circuitry of the fuel flow control valve) to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

In some embodiments, the dispenser may be further configured for additional operations or optional modifications. In this regard, in an example embodiment, the antifraud circuit is further configured to cause the flow control valve to remain in the closed position in response to determining that the signal is not legitimate. In an example embodiment, the signal characteristic is based on signal modulation. In some example embodiments, a legitimate signal is pulse width modulated. In an example embodiment, the antifraud circuit is integral to a magnetic coil housing. In some example embodiments, the antifraud circuit is integral to the flow control valve housing. In some example embodiments, the valve actuator comprises a solenoid. In an example embodiment, a legitimate signal comprises a pulse width modulated signal and the modulation causes a magnetic slug operably coupled to the valve element to oscillate preventing the flow control valve from becoming stuck in the open position. In some example embodiments, the antifraud circuit includes processing circuitry configured to compare the signal to a predetermined signal pattern and cause power to be supplied to the valve actuator in response to the signal matching the predetermined signal pattern. In an example embodiment, the antifraud circuit includes processing circuitry configured to authenticate the signal based on a cryptographic data.

Many modifications and other embodiments of the apparatus and/or methodology set forth herein will come to mind to one skilled in the art to which they pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain representative combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A flow control valve comprising:

a valve aperture in a valve body configured to convey fuel from an inlet to an outlet;

a valve element configured to close the valve aperture to block flow of the fuel;

a valve actuator configured to shift the position of the valve element between a closed position and an open position, the valve actuator being in the form of a solenoid having a movable element surrounded by a magnetic coil; and an antifraud circuit configured to:

receive an actuation signal to open the flow control valve;

determine if the actuation signal is legitimate or not legitimate based on a signal characteristic with the magnetic coil in a consistent position; and cause the flow control valve to shift to the open position in response to determining that the actuation signal is legitimate.

2. The flow control valve of claim 1, wherein the antifraud circuit is further configured to:

cause the flow control valve to remain in the closed position in response to determining that the actuation signal is not legitimate.

3. The flow control valve of claim 1, wherein the signal characteristic is based on signal modulation.

4. The flow control valve of claim 1, wherein a legitimate actuation signal to open the flow control valve is pulse width modulated.

5. The flow control valve of claim 4, wherein the antifraud circuit is integral to a magnetic coil housing.

6. The flow control valve of claim 1, wherein the antifraud circuit is integral to a flow control valve housing.

7. The flow control valve of claim 1, wherein a legitimate actuation signal comprises a pulse width modulated signal.

8. The flow control valve of claim 1, wherein the antifraud circuit includes processing circuitry configured to:

compare the actuation signal to a predetermined signal pattern; and cause power to be supplied to the valve actuator in response to the actuation signal matching the predetermined signal pattern.

9. The flow control valve of claim 1, wherein the antifraud circuit includes processing circuitry configured to:

authenticate the actuation signal based on cryptographic data.

* * * * *